United States Patent [19]

Beehler et al.

[11] Patent Number: 4,831,835

[45] Date of Patent: May 23, 1989

[54] REFRIGERATION SYSTEM

[75] Inventors: James R. Beehler, Osceola, Ind.; Dean R. Ware, Niles, Mich.

[73] Assignee: Tyler Refrigeration Corporation, Niles, Mich.

[21] Appl. No.: 183,832

[22] Filed: Apr. 21, 1988

[51] Int. Cl.[4] ..... F25B 39/04; F25B 41/04

[52] U.S. Cl. ..... 62/196.1; 62/509

[58] Field of Search ..... 62/509, 196.1, 174, 62/DIG. 17

[56] References Cited

U.S. PATENT DOCUMENTS

| | | | |
|---|---|---|---|
| 3,238,737 | 3/1966 | Shrader et al. | 62/174 |
| 4,012,921 | 3/1977 | Willitts et al. | 62/151 |
| 4,136,528 | 1/1979 | Vogel et al. | 62/174 |
| 4,167,102 | 9/1979 | Willitts | 62/509 X |
| 4,457,138 | 7/1984 | Bowman | 62/196.1 |
| 4,562,700 | 1/1986 | Atsumi et al. | 62/174 |
| 4,566,288 | 1/1986 | O'Neal | 62/196.1 |
| 4,621,505 | 11/1986 | Ares et al. | 62/509 |
| 4,735,059 | 4/1988 | O'Neal | 62/196.4 |

*Primary Examiner*—Harry B. Tanner

*Attorney, Agent, or Firm*—William J. Beres; David L. Polsley

[57] ABSTRACT

In refrigeration system, a first solenoid operated valve in parallel disposition with an inlet pressure regulator for refrigerant to a receiver. The refrigeration system also includes a second solenoid operated valve disposed in a receiver bypass line. The first solenoid valve is a normally open valve and the second, bypass solenoid valve is a normally closed valve. A sensor is disposed on the outlet of the condenser of the refrigerant system for determining the condition of refrigerant exiting the condenser. A controller then operates the first solenoid valve and the second solenoid valve to direct flow to the receiver or to bypass the receiver if the refrigerant is subcooled.

16 Claims, 1 Drawing Sheet

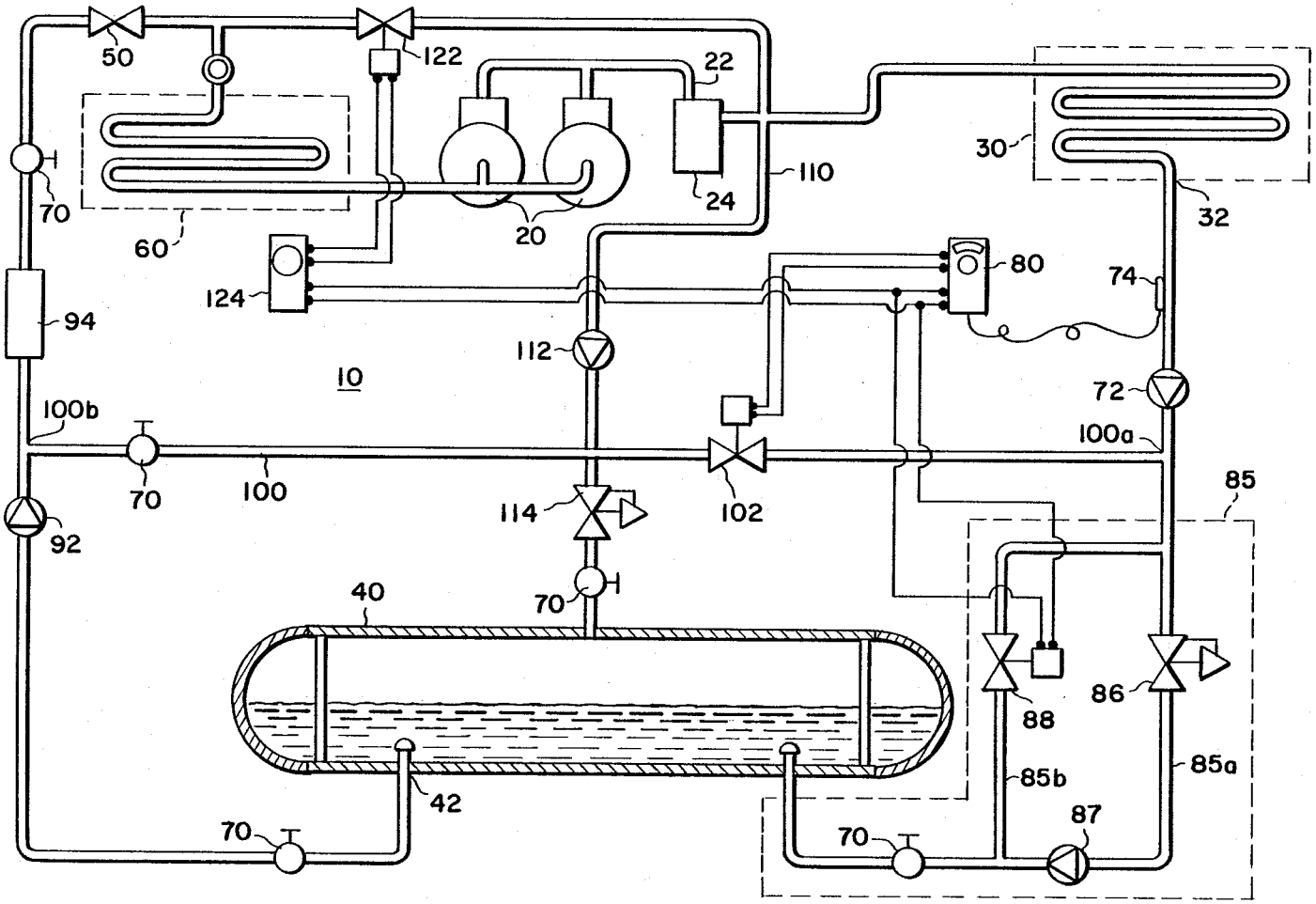
32
30
74
72
100a
85
85a
86
87
88
85b
80
70
110
22
24
102
20
112
114
70
122
42
40
10
124
100
70
60
50
70
94
100b
92

REFRIGERATION SYSTEM

TECHNICAL FIELD

This invention generally pertains to refrigeration systems and specifically to receiver equipped refrigeration systems capable of providing subcooled liquid refrigerant directly to the refrigerant expansion valve.

BACKGROUND ART

In the typical refrigeration system comprised of a compressor, a condenser, an expansion valve and an evaporator for circulating refrigerant in a closed loop connection, it is typical to include a receiver for accepting liquid refrigerant from the outlet of the condenser. This permits the refrigerant, which in many instances is not fully liquified, to separate into gas and liquid components. The liquid component of the refrigerant is then passed through the expansion valve and directed to the evaporator for evaporation. This produces the desirable result of increasing the capacity of the refrigeration system, as the liquid refrigerant absorbs more heat in the evaporator than a mixture of liquid and gas refrigerant, thereby increasing the refrigeration system capacity.

It has also been found desirable, however, to provide liquid refrigerant to the expansion valve in a subcooled condition. This subcooled condition refers to liquid refrigerant that is cooled below the phase change transition temperature of the refrigerant. The subcooled condition of the refrigerant occurs when the condenser is exposed to air with a sufficiently low ambient temperature to cool all the refrigerant leaving the condenser to a subcooled liquid. In a refrigeration system having no receiver, it is not difficult to provide subcooled liquid refrigerant to the expansion valve. The refrigerant is directed from the condenser to the expansion valve without the intermediate step of the receiver, permitting all subcooled refrigerant to directly enter the expansion valve. It is not desirable to direct the subcooled liquid refrigerant to a receiver, as it is warmed by the refrigerant gas provided from the compressor of the refrigeration system to maintain pressure in the receiver and often by the ambient temperature of the receiver. The subcooled liquid is thus warmed, and the benefit of the subcooled liquid is substantially reduced, and may be entirely lost. Likewise, when the condenser cannot provide subcooled liquid for the refrigeration system due to the ambient conditions, it is desirable to have the receiver to permit the liquid and gas components of the refrigerant to be separated to provide only liquid to the expansion valve for maximum refrigeration effect.

There have been several attempts to reconcile these competing solutions so that a refrigeration system can maintain maximum capacity under all conditions. For example, it is common to find a flooded condenser in a refrigeration system. A system utilizing the flooded condenser principal includes either an oversized condenser to insure that the maximum amount of the refrigerant is reduced to the liquid phase change temperature, or may include a complex series of piping to redirect refrigerant to the condenser when the liquid phase change temperature has not been reached. An alternative approach is to provide a separate heat exchanger between the receiver and the expansion valve to act in the capacity of a subcooler to cool the liquid refrigerant leaving the receiver to a subcooled condition. All of the foregoing suffer from the disadvantages of being unnecessarily expensive and complicated, in assembly and maintenance requirements, as well as lower operating efficiency, as the system often requires larger compressor capacity and higher power input to maintain the desired mass flow rate in the system.

These problems are compounded, and the system complexity greatly magnified, in large capacity refrigeration systems having multiple evaporators and multiple compressors. In such systems, the multiple compressors are disposed in parallel arrangement and permit variable flow rates by such means as variable speed operation of the compressors, selective on/off operation of the various compressors, or by loading or unloading the various compressors. Such systems have a high refrigerant mass flow rate, and in order to accommodate this, such refrigeration systems typically require multiple inlet pressure regulation valves at the receiver inlet, since the inlet pressure regulating valves are typically of limited mass flow rate capacity. Also, to permit hot gas defrost of the evaporators of such a refrigeration system, additional complex piping arrangements are required for reversing the gas flow through the refrigeration system. It is typical to provide in parallel a check valve and a solenoid valve to prevent back flow of refrigerant gas to the receiver outlet during hot gas defrost operation of the refrigeration system.

Therefore it is an object of the present invention to provide means for directing subcooled liquid from the condenser to the expansion valve in a refrigeration system having a receiver.

It is a further object of the subject invention to provide such a system as will appropriately direct non-subcooled refrigerant to the receiver.

It is still a further object of the present invention to provide a simple piping arrangement in such a refrigeration system.

It is yet still a further object of the present invention to eliminate the requirement for multiple inlet pressure regulating valves to the receiver of a refrigeration system.

It is another object of the present invention to simplify the piping arrangement required for hot gas defrost in a refrigeration system by eliminating the parallel solenoid valve and check valve at the receiver outlet.

It is a further object of the present invention to provide such a system which is simple to install and maintain.

It is another object of the subject invention to provide such a system which is economical in operation.

These and other objects of the subject invention will become apparent in the drawings and the Description of the Preferred Embodiment which follows herein.

SUMMARY OF THE INVENTION

The subject invention is a multiple compressor refrigeration system having a receiver and a receiver bypass system for providing subcooled liquid refrigerant directly from the condenser to the expansion valve of the refrigeration system when the condenser is providing subcooled liquid. The refrigeration system includes a sensor for determining refrigerant condition at the condenser outlet and a controller for operating a first normally-open solenoid valve disposed in the receiver inlet line and a second normally-closed solenoid valve disposed in the receiver bypass line. The controller, based upon the sensed refrigerant condition, directs the refrigerant through the bypass line or alternately through the receiver inlet line if the refrigerant is insufficiently subcooled. An inlet pressure regulator is disposed in parallel with the first solenoid for permitting refrigerant to enter the receiver when a desired pressure is exceeded, for example, during hot gas defrost cycles when the first solenoid is normally closed.

Normally, when the condenser is exposed to high ambient temperature conditions, all refrigerant from the condenser will be directed to the receiver inlet, and conversely, during lower ambient temperature conditions the refrigerant from the condenser will be subcooled and will be directed through the receiver bypass. During low ambient conditions, the inlet pressure regulator continues to act as a pressure relief valve allowing refrigerant at excessive pressure to flow to the receiver when a selected refrigerant inlet pressure is exceeded at the receiver inlet.

BRIEF DESCRIPTION OF THE DRAWING

The Figure shows a schematic view of the refrigeration system of the subject invention.

DESCRIPTION OF THE PREFERRED EMBODIMENT

The Figure shows a refrigeration system 10 having multiple compressors and hot gas defrost capability embodying the subject invention. The refrigeration system 10 as shown is comprised of two compressors 20 which are placed in flow connection for directing compressed gaseous refrigerant to a condenser 30. The refrigerant is cooled and condensed in the condenser 30 and is directed to a receiver 40 for storage of the liquified refrigerant. Liquified refrigerant is then directed from the receiver 40 through an expansion valve 50 and into an evaporator 60. The refrigerant thus directed then gains heat in the evaporator, undergoing phase change to the gaseous state and is drawn from the evaporator 60 to the compressors 20.

A number of ball-type shut-off valves 70, or the equivalent, are disposed at various locations in the refrigeration system 10. These valves 70 are manually operated and closeable to prevent refrigerant flow at the selected location. This permits isolation of the various components in the refrigeration system 10 for maintenance or replacement for example. The appropriate use and placement of the valves 70 in FIG. 1 is representative and believed to be well known to those skilled in the art.

The refrigeration system 10, as shown in the figure includes two compressors 20, one condenser 30 and a single evaporator 60. It will be readily apparent to those skilled in the art that the refrigeration system 10 may readily include multiple evaporators 60 and multiple condensers 30 in combinations of various sizes and numbers of units as are necessary to supply the refrigeration capacity for a selected site. It will also be readily apparent that the compressors 20 may be of various sizes and numbers of units as are required in a given refrigeration system 10, and further that the compressors 20 may be of the reciprocating piston type, or the scroll or screw type compressors. Also, the expansion valve 50 may be a thermal expansion valve or an electronic expansion valve activated by a suitable controller (not shown). These variations of the refrigeration system 10 are not discussed in detail, as further discussion is not believed necessary to obtain a full and sufficient understanding of the operation of the subject invention. Also, these variations are believed to be well understood by those skilled in the relevant art.

Turning now to the figure in more detail, the refrigeration system 10 is seen to include a back flow preventing check valve 72 disposed at the outlet of the condenser 30. A temperature sensing element 74 is disposed in relation to the outlet of the condenser 30 to sense the temperature of the refrigerant discharged therefrom. The temperature of the refrigerant thus discharged is relayed to a control unit 80, the control unit 80 and the sensing element 74 comprising a control means for determining whether the refrigerant condition is sufficiently or insufficiently subcooled and appropriately operating the refrigerant system 10 in response thereto.

The refrigerant then proceeds from the condenser 30 outlet downstream through the check valve 72 to a receiver inlet portion 85. The receiver inlet portion is comprised of two flow paths disposed in parallel. The first path **85*a* includes a pressure regulating valve 86 and a check valve 87 for admitting refrigerant to the receiver 40. The second path includes a normally open solenoid valve 88 which may be driven closed to prevent flow through the second path by actuation of the solenoid valve 88. Refrigerant entering the receiver inlet portion 85 traverses the first path 85*a* in the event that the refrigerant inlet pressure at the inlet pressure regulating valve 86 exceeds that required to force the valve to a flow permitting condition. The check valve 87 serves to prevent back flow from the receiver 40 to the condenser outlet 32. The refrigerant freely traverses the second path 85*b* in the receiver inlet portion 85 in the event that the solenoid valve 88 is in the normally open position. The solenoid valve 88 may be driven closed to prevent a flow of refrigerant through the second path 85*b*, whereby refrigerant entering the receiver inlet 85 may traverse only the first path 85*a* and a free flow of refrigerant is prevented. Refrigerant traversing either the first path 85*a* or the second path 85*b* is directed into the refrigerant storage chamber defined by the body of the receiver 40. The operation of the solenoid valve 88 in the second path 85*b* is independent of that of the pressure regulating valve 86 and check valve 87 in the first path 85*a***.

The refrigerant then is directed through a receiver outlet 42 through a check valve 92 which prevents a back flow of refrigerant to the receiver outlet 42 and then to a filter drier 94. The filter drier 94 serves the function of removing undesirable water or water vapor and other contaminents from the refrigerant in the refrigeration system 10. Refrigerant is then passed from the filter drier 94 through the expansion valve 50, wherein the refrigerant is expanded. The expanded refrigerant then enters the evaporator 60 for receiving heat and undergoing phase change from the liquid to the gaseous state. The expanded, gaseous refrigerant is drawn by the suction effect of the compressors 20 and compressed in the compressors 20 for recirculation through the refrigeration system 10.

The refrigeration system 10 further includes a bypass line 100. The bypass line 100 has a first end **100*a* disposed between the check valve 72 of the condenser outlet 32 and the receiver inlet portion 85, and a second end 100*b* disposed between the receiver outlet check valve 92 and the filter drier 94. A normally closed solenoid valve 102 is disposed in the bypass line 100 between the first end and the second end. In the normally closed position, the solenoid valve 102 acts to prevent flow through the bypass line 100**.

The control unit 80 is a preferably thermostatic for responding to the signal from the temperature sensing element 74. The control unit 80 is connected to the solenoid valve 88 and the bypass solenoid valve 102 for controlling selective operation of the respective electrically actuated solenoid valves. As is generally known to those skilled in the art of refrigeration system control, it is possible to adjust the control unit 80 to respond to the signal from the temperature sensing element 74 such that the normally open solenoid valve 88 and the normally closed bypass solenoid valve 102 are not energized when the refrigerant temperature sensed by the sensing element 74 exceeds a certain selected temperature. When the refrigerant temperature as sensed by the temperature sensing element 74 decreases below the selected refrigerant temperature, the control unit 80 energizes the solenoid valve 88 to the closed position and the bypass solenoid valve 102 to the open position. Refrigerant flow is thus prevented in this condition through the first path of the receiver inlet portion 85 and freely permitted through the bypass line 100.

It is also possible in the alternative to use a control unit 80 which is pressure responsive, based on a signal from a pressure sensing element 74, as either temperature or pressure may be sensed to indicate the refrigerant condition. The refrigeration system 10 would operate in the same manner in either alternative embodiment.

The refrigerant temperature selected to activate the control unit 80 is the temperature at which the refrigerant becomes subcooled to the desired degree, such as 5° F. or 10° F., below the phase change temperature. When the control unit 80 has energized the respective solenoid valves to cause refrigerant flow through the bypass line 100, refrigerant flow is still permitted through the first flow path 85*a* of the receiver inlet portion 85 in the event that refrigerant pressure exceeds that required to activate the pressure relief valve 86. Thus, the receiver 40 functions to prevent excessive pressure build up in the refrigeration system 10, while subcooled liquid refrigerant flows directly from the condenser 30 to the expansion valve 50 without being subject to any warming effect by refrigerant at or above the phase change temperature stored in the receiver 40.

The refrigeration system 10 in the preferred embodiment also includes a hot gas defrost portion. The hot gas defrost portion is generally disclosed herein as a defrost line operating to supply hot gas refrigerant from the outlet of the oil seperator 24 to the inlet 62 of the evaporator 60. The hot gas defrost line 120 further includes a normally closed solenoid valve 122 which is electrically connected for operation in response to a defrost controller 124. The defrost controller 124 is preferrably a time clock driven controller which energizes the normally closed solenoid valve 122 to the open position permitting hot gas to flow from the compressors to the evaporator inlet 62 for a specified interval upon the lapse of a certain preselected time period. This time period may be, for example, a 24 hour cycle.

The hot gas defrost line 120 as shown is intended to depict in general the hot gas defrost principle and not to provide a detailed description of the operation of such a system, as the specific and various embodiments of such hot gas defrost portions of a refrigeration system 10 are well known to those skilled in the art and need not be described herein in detail.

The solenoid valve 88 in the second path 85*b* of the receiver inlet 85 is preferrably electrically connected to the defrost controller 124 such that the normally open solenoid 88 is driven to the closed position during the portion of the hot gas defrost timer cycle when the normally closed solenoid 122 is energized to the open position. This prevents a flow of refrigerant from the receiver 40 through the second path 85*b* of the receiver inlet portion 85 during the actual defrost portion of the refrigeration system 10 cycle.

A gas supply line 110 branches from the outlet of the oil separator 24 and extends to the receiver 40. A check valve 112 is included in the gas supply line 110 for preventing backflow of gas from the receiver to the outlet of the oil separator 24, and a pressure regulating valve 114 is included in the gas supply line 110 to regulate the pressure maintained within the reservoir 40.

During the portion of the refrigeration system operation when the hot gas defrost is activated, the pressure of the refrigerant gas is metered by the pressure regulating valve 114 to provide sufficient pressure in the receiver 40 to force liquid refrigerant to the evaporator 60 if necessary.

The refrigeration system 10 has three normal modes of operation. In the first mode of operation, the condenser 30 experiences high ambient temperature conditions which are insufficient to cause the desired level of subcooling in the refrigerant discharged at the condenser outlet 32. In this first operating mode, the temperature of the refrigerant sensed by temperature sensor elements 74 is higher than that at which the control unit 80 will energize the respective solenoid valves 88 and 102. Therefore, all liquid and gaseous refrigerant discharged from the condenser 30 is directed to the receiver 40 through the second flow path 85*b* of the receiver inlet portion 88, as the solenoid valve 88 is in its normally open position for permitting free flow of refrigerant to the receiver 40. The solenoid valve 102 in the bypass line 100 is in its normally closed position, thus preventing bypassing of the receiver 40 by refrigerant. All refrigerant being directed to the receiver 40 insures that separation of the liquid component from any gaseous refrigerant will occur, to insure that only liquified refrigerant is directed to the expansion valve 50. This insures the maximum refrigeration capacity of the refrigeration system 10, due to the fact that only refrigerant low enough in temperature to have undergone phase change to the liquid form is directed to the expansion valve 50.

The second normal mode of operation of the refrigeration system 10 occurs when the ambient conditions experienced by the condenser 30 are sufficiently low in temperature to produce sufficient subcooling of the refrigerant discharged from the condenser 30. In this condition, the control unit 80 responds to the low temperature of the refrigerant sensed by the sensing element 74 and energizes the solenoid valve 88 in the second flow path 85*b* to the closed position and the normally closed solenoid valve 102 in the bypass line 100 to the open position. Free flow of the subcooled liquified refrigerant is prevented through the receiver inlet 85, and the refrigerant is therefore permitted to bypass the receiver and proceed directly through the filter dryer 94 to the expansion valve 50. The pressure regulating valve 86 in the first flow path 85*a* acts to permit refrigerant to flow to the receiver 40 in the event that excess refrigerant pressure in the refrigeration system 10 occurs.

The third mode of operation of the refrigeration system 10 is the hot gas defrost portion of the normal refrigeration cycle. This occurs at selected timed intervals as selected for the defrost controller 124. The defrost portion of the refrigeration cycle is superimposed upon the first and second normal modes of operation of the refrigeration system 10.

It is readily seen that the subject invention offers a refrigeration system 10 which provides the maximum refrigeration capacity whether the ambient conditions experienced by the condenser 30 are relatively high or low in temperature. It can also be readily seen that the subject invention avoids the necessity of the installation of multiple pressure regulating inlet valves in the receiver inlet portion 85, requiring only a single, normally open type solenoid actuated valve of sufficient capacity and a single inlet pressure regulating valve regardless of the mass flow rate in the refrigeration system 10. It is further readily apparent that the refrigeration system 10 embodying the subject invention provides a simple means of hot gas defrost which further simplifies the refrigeration system 10 by eliminating any requirement of solenoid valves in the receiver outlet 42. Thus, it can be readily appreciated that the subject invention provides these several benefits and simultaneously lowers the cost and difficulty of installation, manufacture and maintenance of such a refrigeration system 10.

Modifications to the preferred embodiment of the subject invention will be apparent to those skilled in the art within the scope of the claims that follow hereinbelow.

What is claimed is:

1. A refrigeration system for circulating refrigerant in a closed loop connection comprised of:

a condenser for receiving refrigerant from said compressor;

a receiver having a receiver inlet for accepting refrigerant from said condenser outlet, said receiver inlet including means for closing said receiver inlet in a free flow preventing manner, said receiver further including a receiver outlet having means for preventing a backflow of the refrigerant into said receiver;

means for selectively bypassing refrigerant from said condenser outlet to said receiver outlet;

an expansion valve;

an evaporator; and a compressor.

2. The refrigeration system as set forth in claim 1 wherein said means for selectively bypassing refrigerant is further comprised of:

a bypass circuit loop flowably connected between said condenser outlet and said receiver outlet; and means disposed in said bypass circuit loop for selectively preventing refrigerant flow through said bypass circuit loop.

3. The refrigerant system as set forth in claim 2 wherein said means for closing said receiver inlet is further comprised of means for admitting refrigerant to said receiver when a selected refrigerant inlet pressure is exceeded, said refrigerant admitting means being disposed in parallel with said means for closing said receiver inlet whereby said means for admitting refrigerant is independently operable of said means for closing said receiver inlet.

4. The refrigerant system as set forth in claim 3 wherein said means for selectively bypassing refrigerant is further comprised of means for selectively controlling said selective bypass means, said control means controllably connected to said means for preventing flow in said bypass circuit loop and to said means for preventing flow in said receiver inlet.

5. The refrigeration system as set forth in claim 4 wherein said control means is further comprised of means for sensing refrigerant condition at said condenser outlet.

6. A refrigeration system for circulating refrigerant in a closed loop connection comprised of:

an expansion valve for expanding refrigerant;

an evaporator for receiving expanded refrigerant from said expansion valve and evaporating refrigerant to a gaseous state;

a plurality of compressors in parallel disposition for receiving and compressing gaseous refrigerant from the evaporator;

a condenser for receiving compressed gaseous refrigerant from at least one of said compressors and condensing the compressed gaseous refrigerant to liquid refrigerant, said condenser further including a condenser outlet having means for preventing a backflow of refrigerant into said condenser;

a receiver having a receiver inlet for accepting refrigerant from said condenser outlet, said receiver inlet including means for closing said receiver inlet in a free flow preventing manner, said receiver further including a receiver outlet having means for preventing a backflow of refrigerant into said receiver;

means for selectively bypassing refrigerant from said condenser outlet to said receiver outlet.

7. The refrigeration system as set forth in claim 6 wherein said receiver inlet is further comprised of means for admitting refrigerant to said receiver when a selected refrigerant inlet pressure is exceeded, said means for admitting refrigerant being in parallel disposition with said means for closing said receiver inlet whereby a flow of refrigerant is admitted to said receiver when a selected refrigerant pressure is exceeded while a free flow of refrigerant into said receiver is otherwise prevented by said means for closing said receiver inlet.

8. The refrigeration system as set forth in claim 7 wherein said means for admitting refrigerant to said receiver is further comprised of a pressure regulating valve.

9. The refrigeration system as set forth in claim 8 wherein said means for closing said receiver inlet is further comprised of an electrically actuated valve having a first flow permitting position for permitting flow through said valve and a second flow preventing position for preventing refrigerant flow through said valve.

10. The refrigeration system as set forth in claim 9 wherein said means for selectively bypassing refrigerant is further comprised of a bypass circuit having a first end disposed connectingly between said condenser outlet and said receiver inlet and a second end disposed connectingly to said receiver outlet.

11. The refrigeration system as set forth in claim 10 wherein said bypass circuit is further comprised of an electrically actuated valve having a first condition for permitting refrigerant flow through said valve and a second condition for preventing refrigerant flow through said valve.

12. The refrigeration system as set forth in claim 11 wherein said refrigeration system is further comprised of means for controlling said means for selectively bypassing refrigerant and said means for closing said receiver inlet alternately whereby a flow of refrigerant is alternately directed to said receiver and bypasses said receiver.

13. The refrigeration system as set forth in claim 12 wherein said control means includes a refrigerant condition sensor for determining refrigerant condition at said condenser outlet.

14. A refrigeration system for circulating refrigerant in a closed loop connection comprised of:

an expansion valve for expanding refrigerant;

an evaporator for receiving expanded refrigerant from said expansion valve and evaporating refrigerant to a gaseous condition;

a compressor for drawing and compressing gaseous refrigerant from said evaporator;

a condenser for receiving compressed gaseous refrigerant to liquid refrigerant, said condenser further including a condenser outlet having means for preventing a backflow of refrigerant into said condenser;

a receiver having a receiver inlet for accepting refrigerant from said condenser outlet including an electrically actuated receiver inlet valve having a first flow permitting condition and a second flow preventing condition disposed in parallel with means for admitting refrigerant to said receiver when a selected refrigerant inlet pressure is exceeded, said receiver further including a receiver outlet having a means for flow connection to said expansion valve.

a bypass line having a first end disposed connectingly between said condenser outlet and said receiver outlet and a second end disposed connectingly between said receiver outlet and said expansion valve whereby refrigerant bypasses said receiver, said bypass line further including an electrically actuated bypass valve having a first flow permitting condition and a second flow prevent condition;

control means for selectively actuating said receiver inlet valve to said second condition and actuating said bypass valve to said first condition for refrigerant bypass of said receiver and alternately actuating said receiver inlet valve to said first condition and actuating said bypass valve to said second condition to direct refrigerant from said condenser outlet to said receiver.

15. The refrigeration system as set forth in claim 14 wherein said control means is further comprised of means for determining refrigerant subcooling condition at said condenser outlet.

16. The refrigeration system as set forth in claim 15 wherein said control means is further comprised of means for comparing said determined refrigerant subcooling condition to a selected refrigerant subcooling condition such that said control means directs insufficiently subcooled refrigerant to said receiver.

* * * * *

UNITED STATES PATENT AND TRADEMARK OFFICE

CERTIFICATE OF CORRECTION

PATENT NO. : 4,831,835

DATED : May 23, 1989

INVENTOR(S) : James R. Beehler and Dean R. Ware

It is certified that error appears in the above-identified patent and that said Letters Patent is hereby corrected as shown below:

In The Abstract:

Line 1, after "In" insert -- a --.

Column 3, line 48, "figure" should be -- FIGURE --.

Column 4, line 1, "figure" should be -- FIGURE --.

In The Claims:

Claim 14, Column 9, line 13, after "gaseous" insert -- refrigerant from the compressor and condensing compressed gaseous --.

Signed and Sealed this

Eighteenth Day of June, 1991

*Attest:*

HARRY F. MANBECK, JR.

*Attesting Officer*

*Commissioner of Patents and Trademarks*